US010655867B2

(12) United States Patent
Jewell et al.

(10) Patent No.: US 10,655,867 B2
(45) Date of Patent: May 19, 2020

(54) SYSTEM AND METHOD FOR OPERATING A PACKAGED TERMINAL AIR CONDITIONER UNIT

(71) Applicant: Haier US Appliance Solutions, Inc., Wilmington, DE (US)

(72) Inventors: Robert William Jewell, Louisville, KY (US); Bryan Isaac D'Souza, Louisville, KY (US); Timothy Scott Shaffer, La Grange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 95 days.

(21) Appl. No.: 15/878,480

(22) Filed: Jan. 24, 2018

(65) Prior Publication Data

US 2019/0226689 A1 Jul. 25, 2019

(51) Int. Cl.

| | |
|---|---|
| ***F24F 1/027*** | (2019.01) |
| ***F24F 11/81*** | (2018.01) |
| ***F24F 120/12*** | (2018.01) |

(52) U.S. Cl.

CPC ..... *F24F 1/027* (2013.01); *F24F 11/81* (2018.01); *F24F 2120/12* (2018.01)

(58) Field of Classification Search

CPC ..... F24F 1/027; F24F 2120/12; F24F 11/81; F24F 11/61; F24F 11/86; F24F 11/84; F24F 2110/10; F24F 2221/34

See application file for complete search history.

(56) References Cited

U.S. PATENT DOCUMENTS

| | | | | |
|---|---|---|---|---|
| 8,973,845 | B2 | 3/2015 | Kanaya et al. | |
| 10,088,193 | B2 * | 10/2018 | Inui | F24F 11/30 |
| 2009/0032605 | A1 * | 2/2009 | Sullivan | F24F 11/30 236/46 R |
| 2010/0218527 | A1 * | 9/2010 | Kitagishi | F25B 49/025 62/228.5 |
| 2016/0313014 | A1 * | 10/2016 | Phillips | F24F 13/20 |
| 2017/0191720 | A1 * | 7/2017 | Junge | F25B 49/02 |
| 2019/0120518 | A1 * | 4/2019 | Kim | G06K 9/00362 |

FOREIGN PATENT DOCUMENTS

| | | | | |
|---|---|---|---|---|
| JP | 2010139210 | A | 6/2010 | |
| JP | 2012042131 | A * | 3/2012 | |
| JP | 5489915 | B2 | 5/2014 | |
| WO | WO-2017204499 | A1 * | 11/2017 | G06K 9/00362 |

* cited by examiner

*Primary Examiner* — Ana M Vazquez
(74) *Attorney, Agent, or Firm* — Dority & Manning, P.A.

(57) ABSTRACT

A packaged terminal air conditioner unit (PTAC) and methods for operating the same are provided. A PTAC controller is operably coupled to a proximity indication device for detecting that a proximity trigger condition exists and is configured for adjusting an operating parameter of the PTAC to adjust an outlet temperature of a flow of discharge air in response to determining that the proximity trigger condition exists. The proximity trigger condition may exist when a proximity sensor detects an occupant close to the PTAC, when a user input button is activated, or when a voice command is received.

18 Claims, 9 Drawing Sheets

SYSTEM AND METHOD FOR OPERATING A PACKAGED TERMINAL AIR CONDITIONER UNIT

FIELD OF THE INVENTION

The present disclosure relates generally to air conditioner units, and more particularly to packaged terminal air conditioner units and related methods of operation.

BACKGROUND OF THE INVENTION

Air conditioner or conditioning units are conventionally utilized to adjust the temperature indoors—i.e. within structures such as dwellings and office buildings. Such units commonly include a closed refrigeration loop to heat or cool the indoor air. Typically, the indoor air is recirculated while being heated or cooled. A variety of sizes and configurations are available for such air conditioner units. For example, some units may have one portion installed within the indoors that is connected, by e.g., tubing carrying the refrigerant, to another portion located outdoors. These types of units are typically used for conditioning the air in larger spaces.

Another type of unit, sometimes referred to as a packaged terminal air conditioner unit (PTAC), may be used for somewhat smaller indoor spaces that are to be air conditioned. These units may include both an indoor portion and an outdoor portion separated by a bulkhead and may be installed in windows or positioned within an opening of an exterior wall of a building. PTACs often heat a room most efficiently by urging tepid or relatively warm air (e.g., around 80° F.) into the room at a relatively high flow rate. However, due to the proximity of the PTAC unit and its discharge vent to the room occupants, these occupants frequently complain that the discharge air is too cool and prefer a higher temperature discharge when they are close to the unit, e.g., to heat their hands or warm their bodies quickly.

Accordingly, improved air conditioner units and methods for heating a room would be useful. More specifically, a packaged terminal air conditioner unit that can heat a room while selectively providing a flow of air at increased temperature for occupant comfort would be particularly beneficial.

BRIEF DESCRIPTION OF THE INVENTION

The present subject matter provides a packaged terminal air conditioner unit (PTAC) and methods for operating the same. A PTAC controller is operably coupled to a proximity indication device for detecting that a proximity trigger condition exists and is configured for adjusting an operating parameter of the PTAC to adjust an outlet temperature of a flow of discharge air in response to determining that the proximity trigger condition exists. The proximity trigger condition may exist when a proximity sensor detects an occupant close to the PTAC, when a user input button is activated, or when a voice command is received. Additional aspects and advantages of the invention will be set forth in part in the following description, may be obvious from the description, or may be learned through practice of the invention.

In accordance with one embodiment, a packaged terminal air conditioner unit is provided. The packaged terminal air conditioner unit includes a bulkhead defining an indoor portion and an outdoor portion and a refrigeration loop including an outdoor heat exchanger positioned within the outdoor portion and an indoor heat exchanger positioned within the indoor portion. A compressor is operably coupled to the refrigeration loop and is configured for urging a flow of refrigerant through the outdoor heat exchanger and the indoor heat exchanger. An indoor fan is configured for urging a flow of discharge air through the indoor heat exchanger and out a discharge vent. A controller is operably coupled to a proximity indication device and configured for determining that a proximity trigger condition exists using the proximity indication device and adjusting an operating parameter of the packaged terminal air conditioner to adjust an outlet temperature of the flow of discharge air in response to determining that the proximity trigger condition exists.

In accordance with another embodiment, a method of operating a packaged terminal air conditioner unit is provided. The packaged terminal conditioner unit includes a compressor for urging a flow of refrigerant through an indoor heat exchanger and an indoor fan configured for urging a flow of discharge air through the indoor heat exchanger and out a discharge vent. The method includes determining that a proximity trigger condition exists using a proximity indication device, determining a target temperature based on the proximity trigger condition, and adjusting an operating parameter of the packaged terminal air conditioner to adjust an outlet temperature of the flow of discharge air to the target temperature in response to determining that the proximity trigger condition exists.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
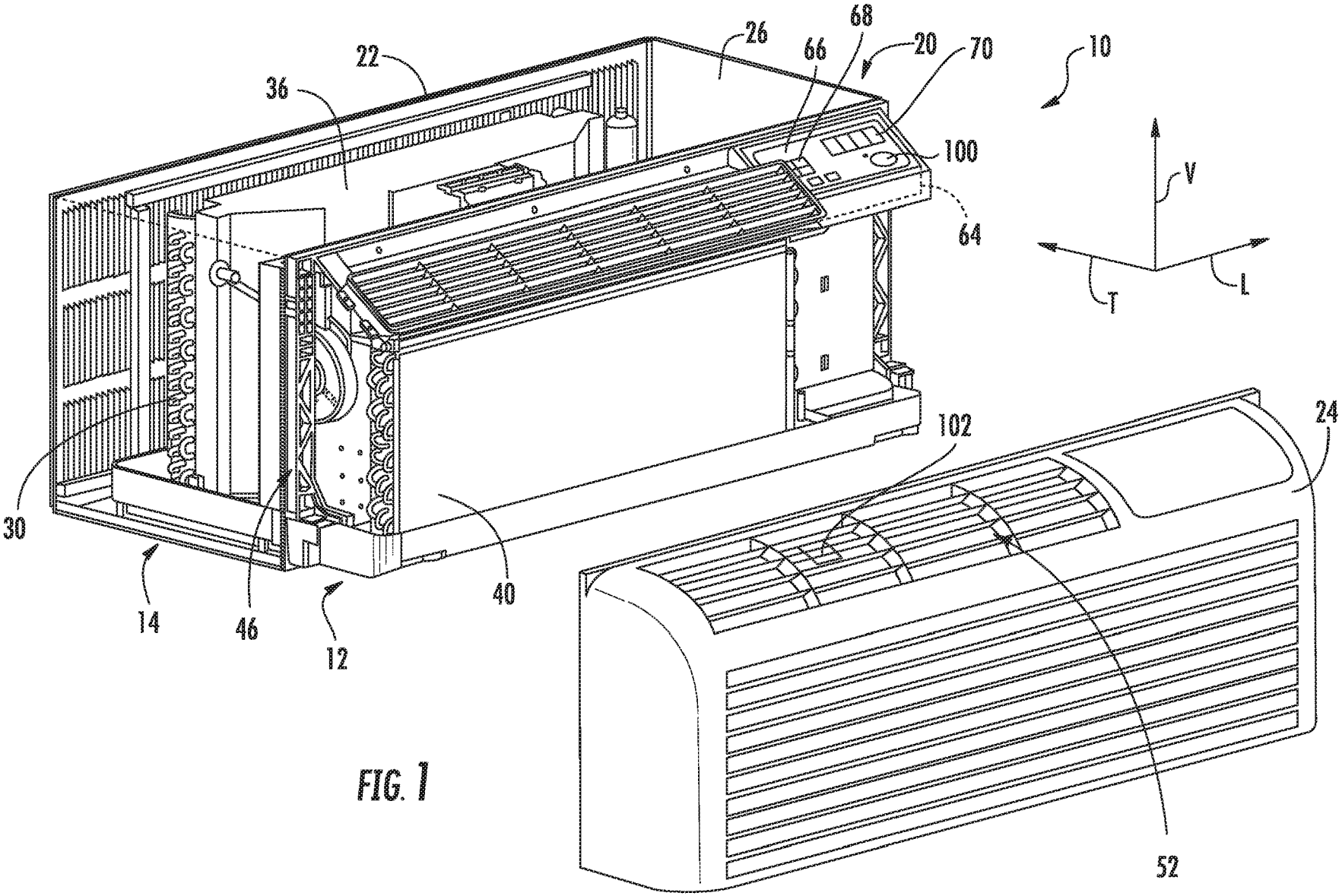
FIG. 1 provides a perspective view of an air conditioner unit, with part of an indoor portion exploded from a remainder of the air conditioner unit for illustrative purposes, in accordance with one exemplary embodiment of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to FIG. 1, an air conditioner unit 10 is provided. The air conditioner unit 10 is a one-unit type air conditioner, also conventionally referred to as a room air conditioner or a packaged terminal air conditioner (PTAC). The unit 10 includes an indoor portion 12 and an outdoor portion 14, and generally defines a vertical direction V, a lateral direction L, and a transverse direction T. Each direction V, L, T is perpendicular to each other, such that an orthogonal coordinate system is generally defined.

A housing 20 of the unit 10 may contain various other components of the unit 10. Housing 20 may include, for example, a rear grill 22 and a front panel 24 which may be spaced apart along the transverse direction T by a wall sleeve 26. The rear grill 22 may be part of the outdoor portion 14, and the front panel 24 may be part of the indoor portion 12. Components of the outdoor portion 14, such as an outdoor heat exchanger 30, an outdoor fan 32 (FIG. 2), and a compressor 34 (FIG. 2) may be housed within the wall sleeve 26. A casing 36 may additionally enclose outdoor fan 32, as shown.

Figure 2:
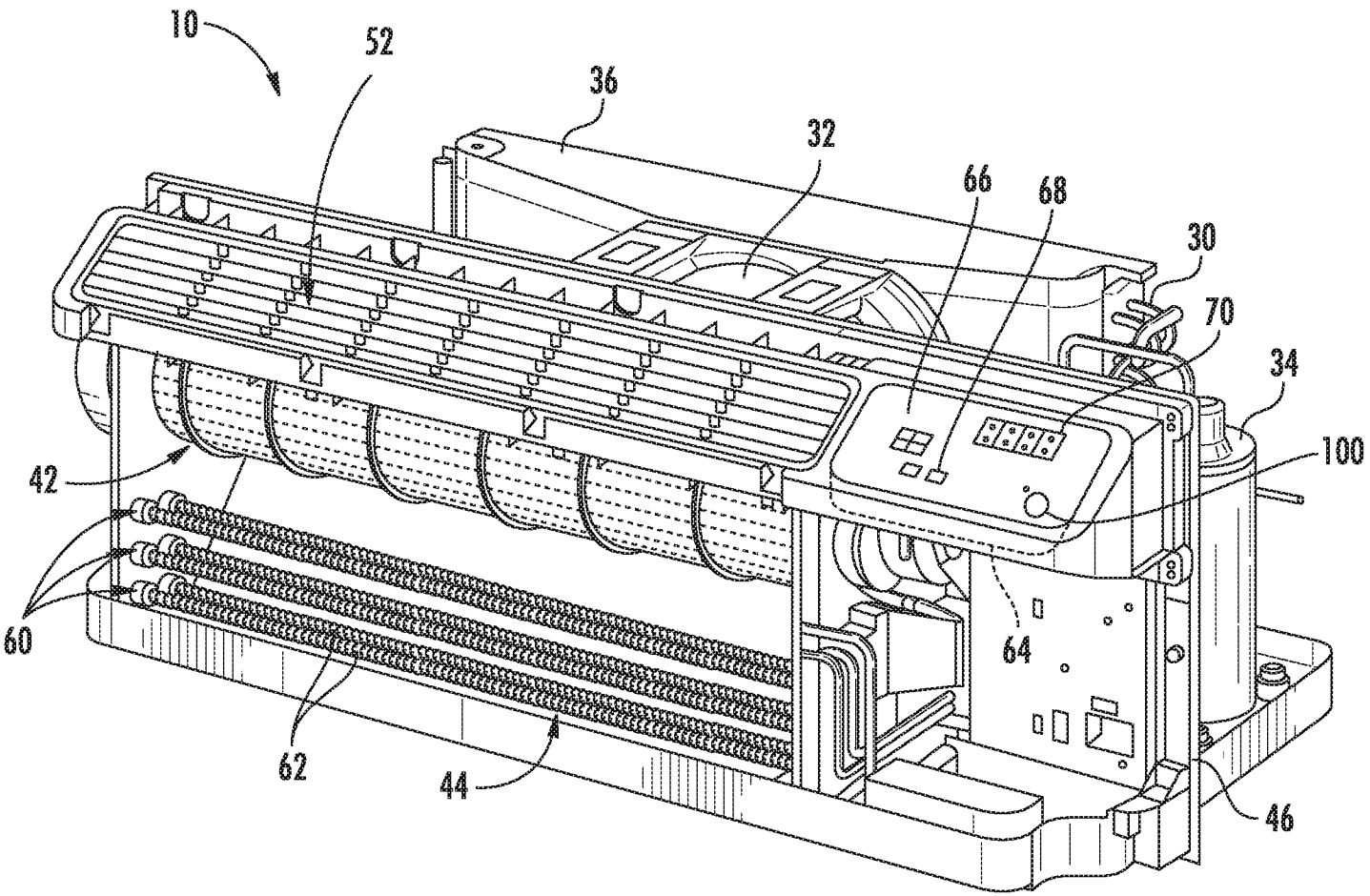
FIG. 2 is another perspective view of components of the indoor portion of the exemplary air conditioner unit of FIG. 1.

Referring now also to FIG. 2, indoor portion 12 may include, for example, an indoor heat exchanger 40 (FIG. 1), a blower fan or indoor fan 42, and a heating unit 44. These components may, for example, be housed behind the front panel 24. Additionally, a bulkhead 46 may generally support and/or house various other components or portions thereof of the indoor portion 12, such as indoor fan 42 and the heating unit 44. Bulkhead 46 may generally separate and define the indoor portion 12 and outdoor portion 14.

Figure 3:
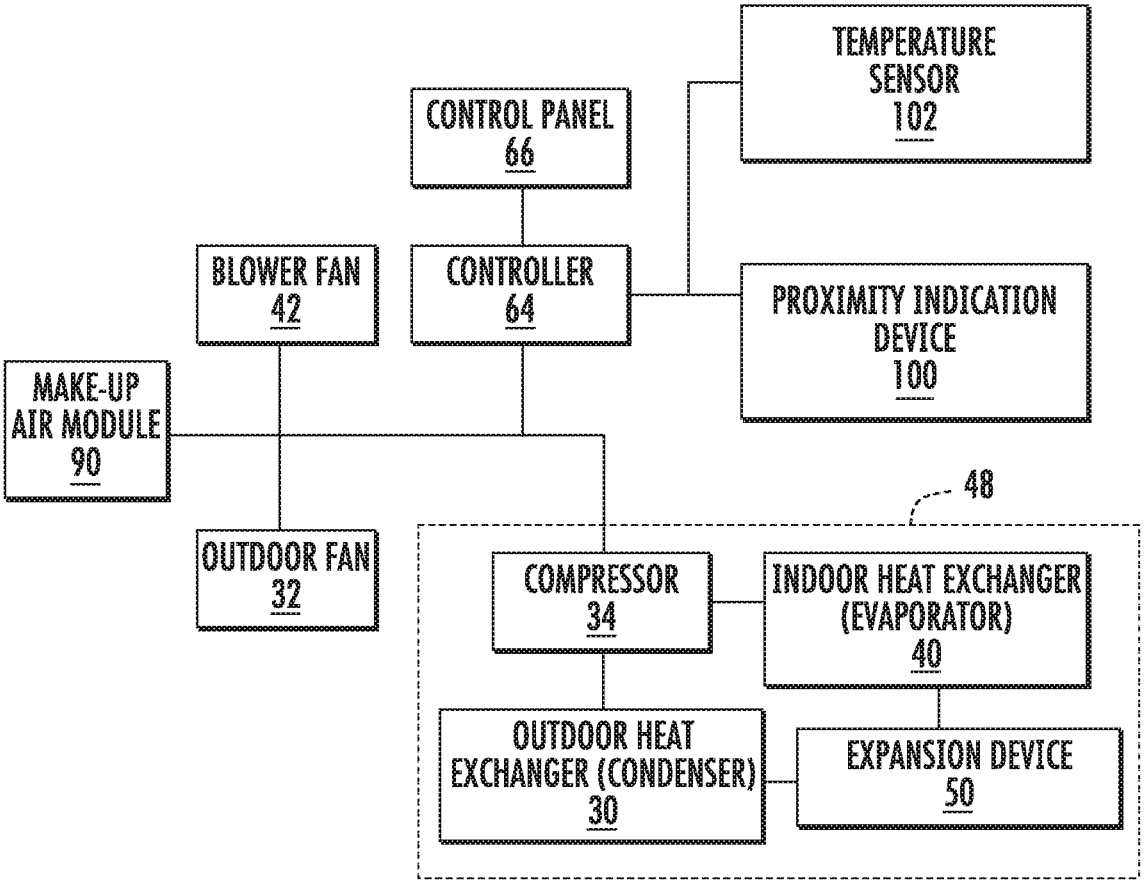
FIG. 3 is a schematic view of a refrigeration loop in accordance with one embodiment of the present disclosure.

Outdoor and indoor heat exchangers 30, 40 may be components of a refrigeration loop 48, which is shown schematically in FIG. 3. Refrigeration loop 48 may, for example, further include compressor 34 and an expansion device 50. As illustrated, compressor 34 and expansion device 50 may be in fluid communication with outdoor heat exchanger 30 and indoor heat exchanger 40 to flow refrigerant therethrough as is generally understood. More particularly, refrigeration loop 48 may include various lines for flowing refrigerant between the various components of refrigeration loop 48, thus providing the fluid communication there between. Refrigerant may thus flow through such lines from indoor heat exchanger 40 to compressor 34, from compressor 34 to outdoor heat exchanger 30, from outdoor heat exchanger 30 to expansion device 50, and from expansion device 50 to indoor heat exchanger 40. The refrigerant may generally undergo phase changes associated with a refrigeration cycle as it flows to and through these various components, as is generally understood. Suitable refrigerants for use in refrigeration loop 48 may include pentafluoroethane, difluoromethane, or a mixture such as R410a, although it should be understood that the present disclosure is not limited to such example and rather that any suitable refrigerant may be utilized.

As is understood in the art, refrigeration loop 48 may alternately be operated as a refrigeration assembly (and thus perform a refrigeration cycle) or a heat pump (and thus perform a heat pump cycle). As shown in FIG. 3, when refrigeration loop 48 is operating in a cooling mode and thus performs a refrigeration cycle, the indoor heat exchanger 40 acts as an evaporator and the outdoor heat exchanger 30 acts as a condenser. Alternatively, when the assembly is operating in a heating mode and thus performs a heat pump cycle, the indoor heat exchanger 40 acts as a condenser and the outdoor heat exchanger 30 acts as an evaporator. The outdoor and indoor heat exchangers 30, 40 may each include coils through which a refrigerant may flow for heat exchange purposes, as is generally understood.

According to an example embodiment, compressor 34 may be a variable speed compressor. In this regard, compressor 34 may be operated at various speeds depending on the current air conditioning needs of the room and the demand from refrigeration loop 48. For example, according to an exemplary embodiment, compressor 34 may be configured to operate at any speed between a minimum speed, e.g., 1500 revolutions per minute (RPM), to a maximum rated speed, e.g., 4800 RPM. Notably, use of variable speed compressor 34 enables efficient operation of refrigeration loop 48 (and thus air conditioner unit 10), minimizes unnecessary noise when compressor 34 does not need to operate at full speed, and ensures a comfortable environment within the room.

In exemplary embodiments as illustrated, expansion device 50 may be disposed in the outdoor portion 14 between the indoor heat exchanger 40 and the outdoor heat exchanger 30. According to the exemplary embodiment, expansion device 50 may be an electronic expansion valve that enables controlled expansion of refrigerant, as is known in the art. More specifically, electronic expansion device 50 may be configured to precisely control the expansion of the refrigerant to maintain, for example, a desired temperature differential of the refrigerant across the indoor heat exchanger 40. In other words, electronic expansion device 50 throttles the flow of refrigerant based on the reaction of the temperature differential across indoor heat exchanger 40 or the amount of superheat temperature differential, thereby ensuring that the refrigerant is in the gaseous state entering compressor 34. According to alternative embodiments, expansion device 50 may be a capillary tube or another suitable expansion device configured for use in a thermodynamic cycle.

According to the illustrated exemplary embodiment, outdoor fan 32 is an axial fan and indoor fan 42 is a centrifugal fan. However, it should be appreciated that according to alternative embodiments, outdoor fan 32 and indoor fan 42 may be any suitable fan type. In addition, according to an exemplary embodiment, outdoor fan 32 and indoor fan 42 are variable speed fans. For example, outdoor fan 32 and indoor fan 42 may rotate at different rotational speeds, thereby generating different air flow rates. It may be desirable to operate fans 32, 42 at less than their maximum rated speed to ensure safe and proper operation of refrigeration loop 48 at less than its maximum rated speed, e.g., to reduce noise when full speed operation is not needed. In addition, according to alternative embodiments, fans 32, 42 may be operated to urge make-up air into the room.

According to the illustrated embodiment, indoor fan 42 may operate as an evaporator fan in refrigeration loop 48 to encourage the flow of air through indoor heat exchanger 40. Accordingly, indoor fan 42 may be positioned downstream of indoor heat exchanger 40 along the flow direction of indoor air and downstream of heating unit 44. Alternatively, indoor fan 42 may be positioned upstream of indoor heat exchanger 40 along the flow direction of indoor air, and may operate to push air through indoor heat exchanger 40. According to exemplary embodiments, indoor fan 42 is generally configured for urging a flow of discharge air through indoor heat exchanger 40 and out a discharge vent 52 defined by front panel 24.

Heating unit 44 in exemplary embodiments includes one or more heater banks 60. Each heater bank 60 may be operated as desired to produce heat. In some embodiments as shown, three heater banks 60 may be utilized. Alternatively, however, any suitable number of heater banks 60 may be utilized. Each heater bank 60 may further include at least one heater coil or coil pass 62, such as in exemplary embodiments two heater coils or coil passes 62. Alternatively, other suitable heating elements may be utilized.

The operation of air conditioner unit 10 including compressor 34 (and thus refrigeration loop 48 generally) indoor fan 42, outdoor fan 32, heating unit 44, expansion device 50, and other components of refrigeration loop 48 may be controlled by a processing device such as a controller 64. Controller 64 may be in communication (via for example a suitable wired or wireless connection) to such components of the air conditioner unit 10. As described in more detail below with respect to FIG. 7, the controller 64 may include a memory and one or more processing devices such as microprocessors, CPUs or the like, such as general or special purpose microprocessors operable to execute programming instructions or micro-control code associated with operation of unit 10. The memory may represent random access memory such as DRAM, or read only memory such as ROM or FLASH. In one embodiment, the processor executes programming instructions stored in memory. The memory may be a separate component from the processor or may be included onboard within the processor.

Unit 10 may additionally include a control panel 66 and one or more user inputs 68, which may be included in control panel 66. The user inputs 68 may be in communication with the controller 64. A user of the unit 10 may interact with the user inputs 68 to operate the unit 10, and user commands may be transmitted between the user inputs 68 and controller 64 to facilitate operation of the unit 10 based on such user commands. A display 70 may additionally be provided in the control panel 66, and may be in communication with the controller 64. Display 70 may, for example be a touchscreen or other text-readable display screen, or alternatively may simply be a light that can be activated and deactivated as required to provide an indication of, for example, an event or setting for the unit 10.

Figure 4:
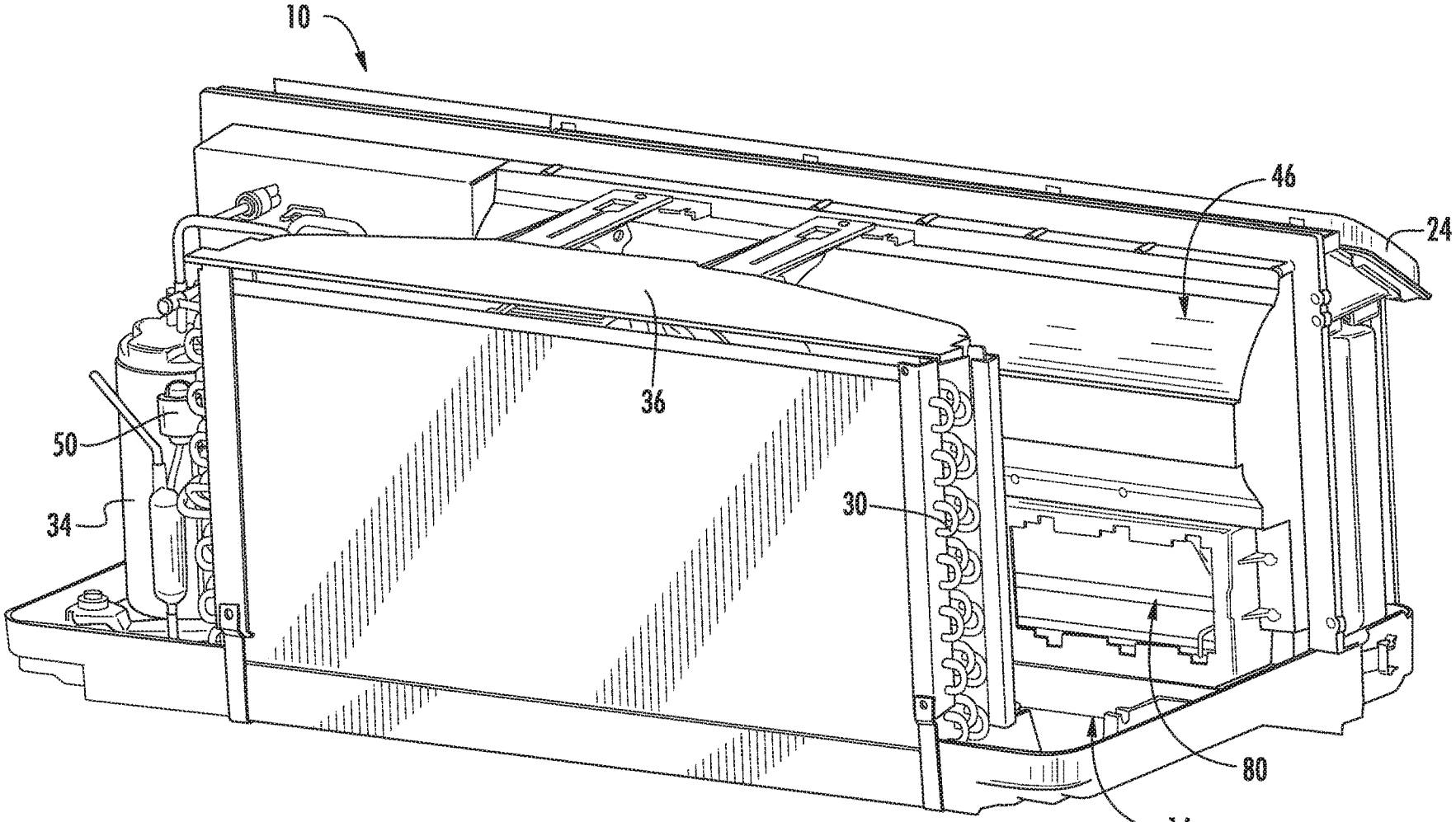
FIG. 4 is a rear perspective view of an outdoor portion of the exemplary air conditioner unit of FIG. 1, illustrating a vent aperture in a bulkhead in accordance with one embodiment of the present disclosure.

Referring briefly to FIG. 4, a vent aperture 80 may be defined in bulkhead 46 providing fluid communication between indoor portion 12 and outdoor portion 14. Vent aperture 80 may be utilized in an installed air conditioner unit 10 to allow outdoor air to flow into the room through the indoor portion 12. In this regard, in some cases it may be desirable to allow outside air (i.e., "make-up air") to flow into the room in order, e.g., to meet government regulations, or to compensate for negative pressure created within the room. In this manner, according to an exemplary embodiment, make-up air may be provided into the room through vent aperture 80 when desired.

Figure 5:
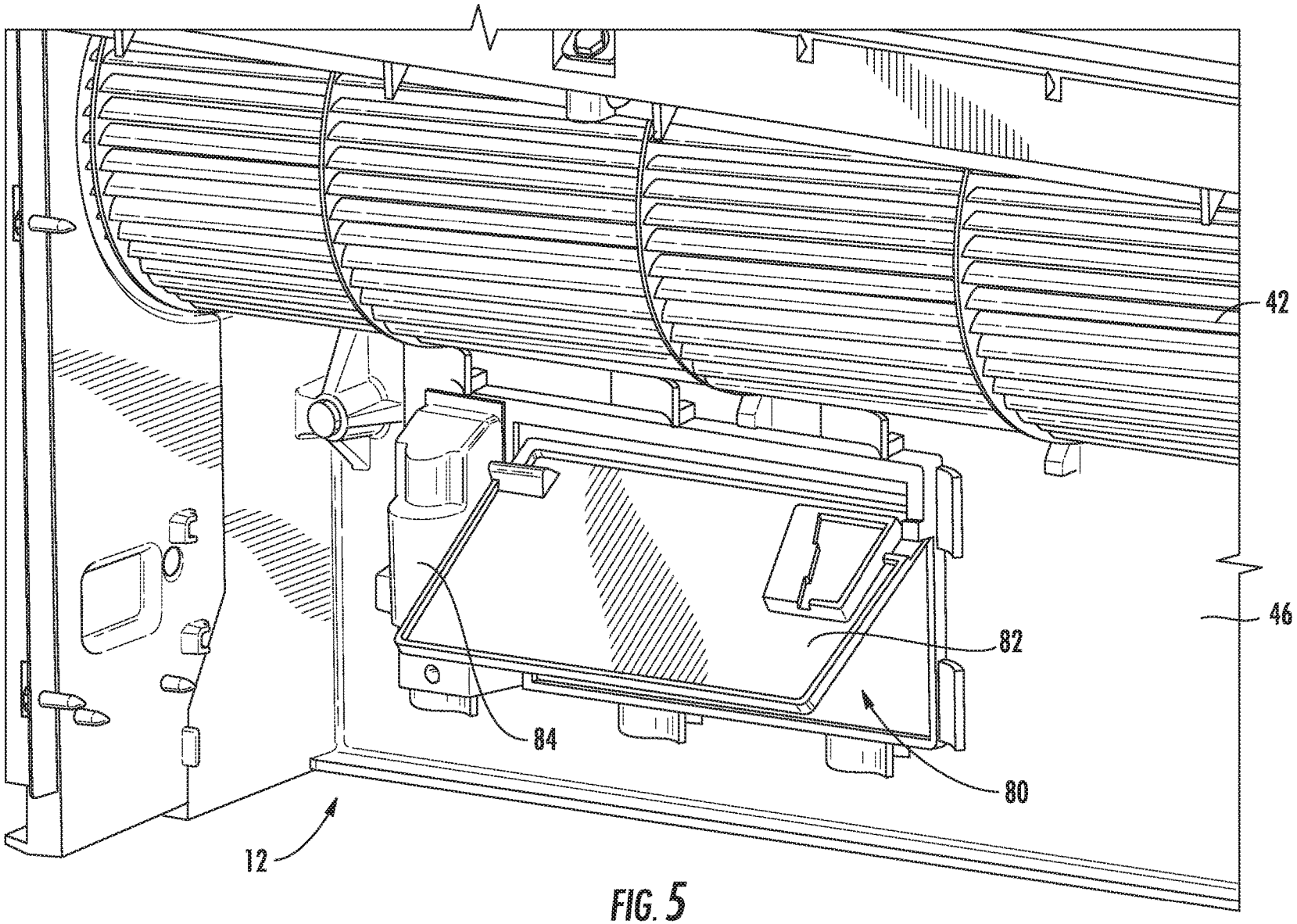
FIG. 5 is a front perspective view of the exemplary bulkhead of FIG. 4 with a vent door illustrated in the open position in accordance with one embodiment of the present disclosure.

As shown in FIG. 5, a vent door 82 may be pivotally mounted to the bulkhead 46 proximate to vent aperture 80 to open and close vent aperture 80. More specifically, as illustrated, vent door 82 is pivotally mounted to the indoor facing surface of indoor portion 12. Vent door 82 may be configured to pivot between a first, closed position where vent door 82 prevents air from flowing between outdoor portion 14 and indoor portion 12, and a second, open position where vent door 82 is in an open position (as shown in FIG. 5) and allows make-up air to flow into the room. According to the illustrated embodiment vent door 82 may be pivoted between the open and closed position by an electric motor 84 controlled by controller 64, or by any other suitable method.

Figure 6:
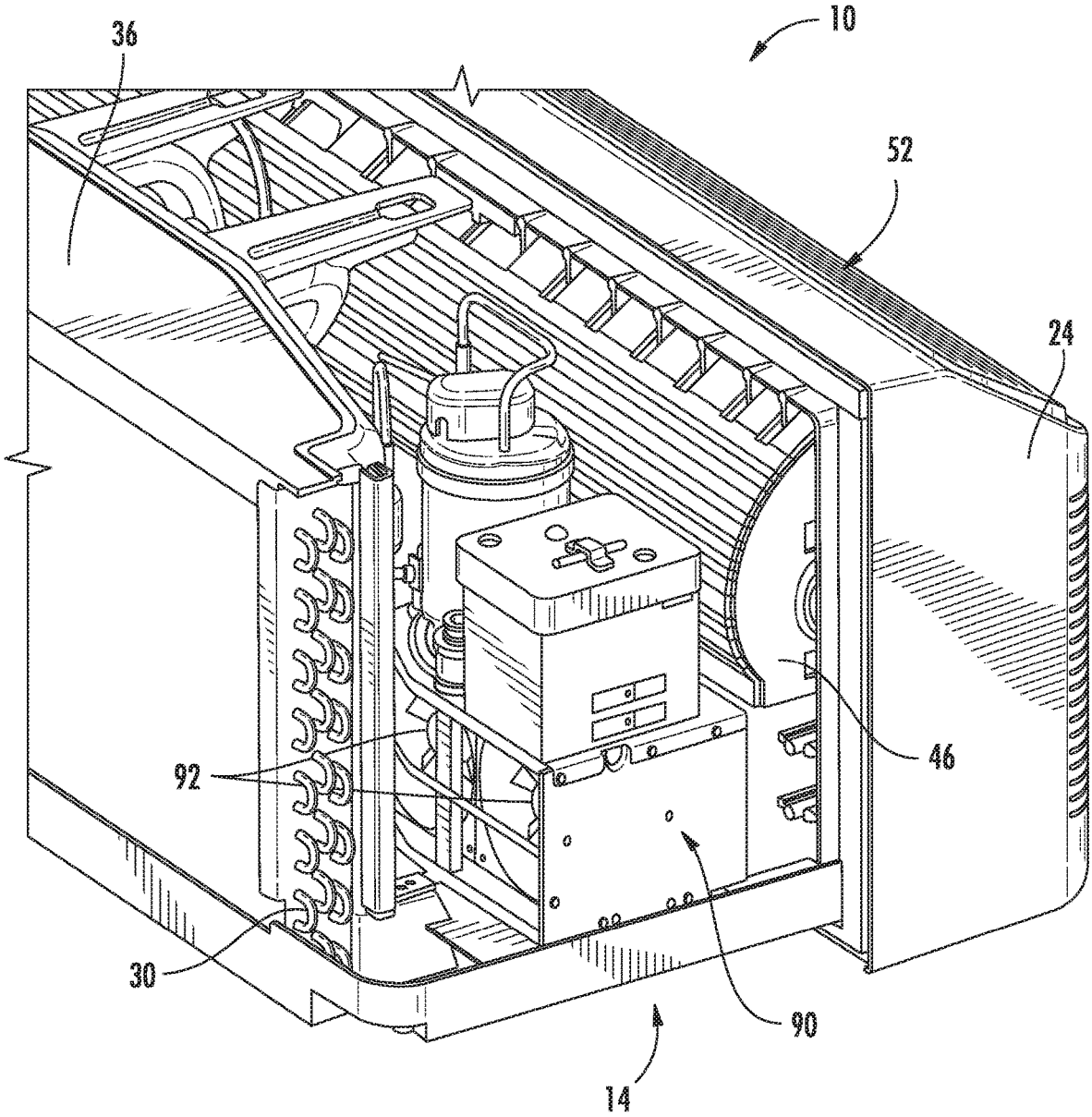
FIG. 6 is a rear perspective view of the exemplary air conditioner unit and bulkhead of FIG. 4 including a sealed system for conditioning make-up air in accordance with one embodiment of the present disclosure.

In some cases, it may be desirable to treat or condition make-up air flowing through vent aperture 80 prior to blowing it into the room. For example, outdoor air which has a relatively high humidity level may require treating before passing into the room. In addition, if the outdoor air is cool, it may be desirable to heat the air before blowing it into the room. Therefore, as illustrated in FIG. 6, unit 10 may further include an auxiliary sealed system, or make-up air module 90, for conditioning make-up air. As shown, make-up air module 90 and/or an auxiliary fan 92 are positioned within outdoor portion 14 adjacent vent aperture 80 and vent door 82 is positioned within indoor portion 12 over vent aperture 80, though other configurations are possible. According to the illustrated embodiment auxiliary sealed system 90 may be controlled by controller 64, by another dedicated controller, or by any other suitable method.

As illustrated, make-up air module 90 includes auxiliary fan 92 that is configured as part of auxiliary sealed system 90 and may be configured for urging a flow of air through auxiliary sealed system 90. Auxiliary sealed system 90 may further include one or more compressors, heat exchangers, and any other components suitable for operating auxiliary sealed system 90 similar to refrigeration loop 48 described above to condition make-up air. For example, auxiliary system 90 can be operated in a dehumidification mode, an air conditioning mode, a heating mode, a fan only mode where only auxiliary fan 92 is operated to supply outdoor air, an idle mode, etc.

Figure 7:
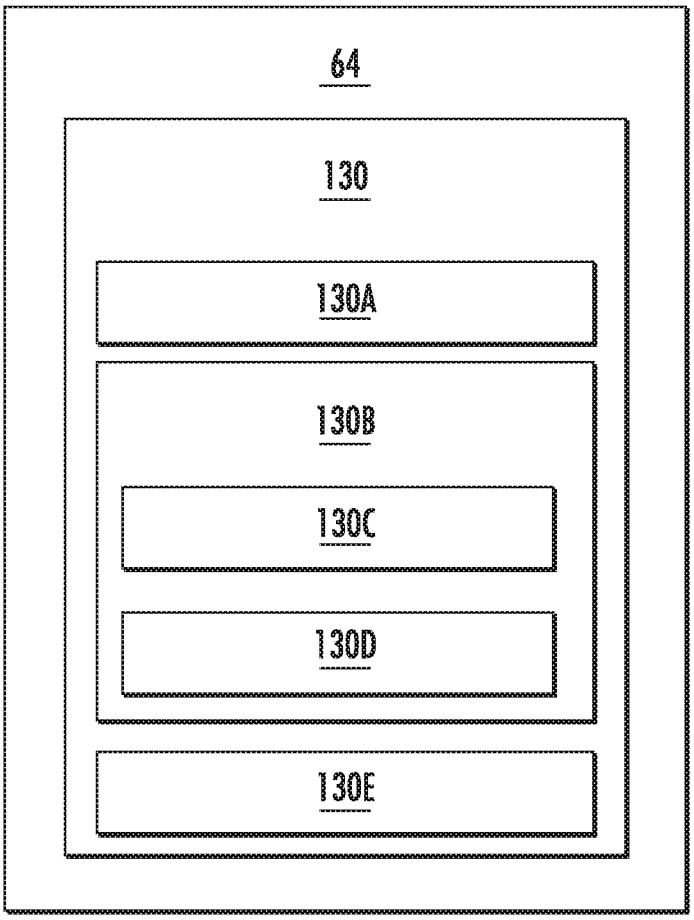
FIG. 7 depicts certain components of a controller according to example embodiments of the present subject matter.

FIG. 7 depicts certain components of controller 64 according to example embodiments of the present disclosure. Controller 64 can include one or more computing device(s) 130 which may be used to implement methods as described herein. Computing device(s) 130 can include one or more processor(s) 130A and one or more memory device (s) 130B. The one or more processor(s) 130A can include any suitable processing device, such as a microprocessor, microcontroller, integrated circuit, an application specific integrated circuit (ASIC), a digital signal processor (DSP), a field-programmable gate array (FPGA), logic device, one or more central processing units (CPUs), graphics processing units (GPUs) (e.g., dedicated to efficiently rendering images), processing units performing other specialized calculations, etc. The memory device(s) 130B can include one or more non-transitory computer-readable storage medium (s), such as RAM, ROM, EEPROM, EPROM, flash memory devices, magnetic disks, etc., and/or combinations thereof.

The memory device(s) 130B can include one or more computer-readable media and can store information accessible by the one or more processor(s) 130A, including instructions 130C that can be executed by the one or more processor(s) 130A. For instance, the memory device(s) 130B can store instructions 130C for running one or more software applications, displaying a user interface, receiving user input, processing user input, etc. In some implementations, the instructions 130C can be executed by the one or more processor(s) 130A to cause the one or more processor (s) 130A to perform operations, e.g., such as one or more portions of methods described herein. The instructions 130C can be software written in any suitable programming language or can be implemented in hardware. Additionally, and/or alternatively, the instructions 130C can be executed in logically and/or virtually separate threads on processor(s) 130A.

The one or more memory device(s) 130B can also store data 130D that can be retrieved, manipulated, created, or stored by the one or more processor(s) 130A. The data 130D can include, for instance, data to facilitate performance of methods described herein. The data 130D can be stored in one or more database(s). The one or more database(s) can be connected to controller 64 by a high bandwidth LAN or WAN, or can also be connected to controller through network(s) (not shown). The one or more database(s) can be split up so that they are located in multiple locales. In some implementations, the data 130D can be received from another device.

The computing device(s) 130 can also include a communication module or interface 130E used to communicate with one or more other component(s) of controller 64 or unit 10 over the network(s). The communication interface 130E can include any suitable components for interfacing with one or more network(s), including for example, transmitters, receivers, ports, controllers, antennas, or other suitable components.

As explained above, during a normal heating operation, refrigeration loop 48 and unit 10 generally push slightly warm or tepid air through discharge vent 52 and into the room at a relatively high flow rate. Such an operating condition, which may be referred to herein as "standard heating mode" or operation under "standard operating parameters," may be an efficient operating point for unit 10. Thus, it may be generally desirable to operate under standard operating parameters to improve unit efficiency during a heating operation. However, when an occupant approaches unit 10, the flow of discharge air exiting discharge vent 52 may generally feel too cold and result in service calls or general dissatisfaction with unit 10. Thus, in certain circumstances, it may also be desirable to adjust the operation of unit 10 to urge warmer air out of discharge vent 52, such as when a room occupant is close to unit 10 and wishes to warm their hands.

Therefore, unit 10 may further include a proximity indication device 100 for detecting when an occupant is close to unit 10 such that the outlet temperature of the flow of discharge air should be increased to improve occupant comfort and satisfaction. More generally, proximity indication device 100 may be used for detecting a proximity trigger condition which indicates that the outlet temperature should be increased. As used herein, "proximity trigger condition" is used to refer to any sequence of events, operating characteristics of unit 10 or the surrounding area, the presence or proximity of room occupants, or any other suitable indication of the desirability of increasing the temperature of the flow of discharge air exiting discharge vent 52. In this regard, controller 64 may be operably coupled to proximity indication device 100 and may adjust one or more operating parameters of unit 10 in response to the existence of a proximity trigger condition. Examples of proximity indication devices 100, proximity trigger conditions, and resulting operating parameter adjustments will be described in detail below according to exemplary embodiments.

According to an exemplary embodiment, proximity indication device 100 may include a proximity sensor or a motion detection sensor which is generally configured for detecting the presence and/or proximity of an occupant or one of their body parts, e.g., the presence of the occupant's hand over discharge vent 52. The proximity sensor or motion detection sensor may be an optical sensor, an infrared sensor, an electromagnetic sensor, a capacitive senor, or any other suitable sensor or device for detecting the presence or proximity of the occupant. According to the illustrated embodiment, proximity indication device 100 is positioned within front panel 24 of unit 10, e.g., on control panel 66 (see, e.g., FIG. 1). However, proximity indication device 100 may be any other suitable type of sensor and may be positioned at any other suitable location.

According to another exemplary embodiment, proximity indication device 100 may be used to indicate a proximity trigger condition based not on the presence or proximity of an occupant, but instead based on an occupant's command. In this regard, unit 10 may include a user input button (e.g., such as a user input button 68 on control panel 66) which a user or occupant may press to enter an operating mode where the outlet temperature of the flow of discharge air is increased, e.g., a "hand heating" mode. By contrast, any other suitable means for receiving an indication from a user that such a hand heating mode should be entered may be used. For example, unit 10 may include a voice command system including a microphone (not shown) which is operably coupled to controller 64 and is configured for receiving voice commands. An occupant may cause unit 10 to adjust or increase the outlet temperature by giving a voice command through the voice command system, e.g., by stating "increase outlet temperature" or "enter hand heating mode."

As explained above, controller 64 is configured for regulating the outlet temperature of the flow of discharge air exiting discharge vent 52 based on the existence of a proximity trigger condition. In this regard, for example, unit 10 may include a temperature sensor 102 positioned within indoor portion 12 for measuring the outlet temperature. When the proximity trigger condition is detected, unit 10 may adjust operating parameters to adjust or increase the outlet temperature of the flow of discharge air.

Notably, controller 64 may increase the outlet temperature in an open-ended manner or may regulate the outlet temperature to a target temperature. In this regard, for example, controller 64 may obtain an outlet temperature using temperature sensor 102 and selectively adjust an operating parameter, e.g., indoor fan 42 or compressor 34 to control the outlet temperature to the target temperature. The outlet temperature is preferably above the room set point temperature and the standard operating temperature of unit 10. For example, the target temperature may be greater than 90 degrees Fahrenheit when the proximity trigger condition exists. According to still other embodiments, the target temperature may vary depending on the conditions within the room or may be any other fixed temperature. The target temperature may also be set by a user, e.g., using user inputs 68 on control panel 66 to increase or decrease the target temperature.

Thus, when a proximity trigger exists, controller 64 adjusts one or more operating parameters of unit 10 to achieve such a temperature increase. As used herein, an "operating parameter" of unit 10 is any component setting, speed, configuration, or other operating characteristic that may affect the outlet temperature of the flow of discharge air through discharge vent 52. Notably, the outlet temperature may be measured as an absolute temperature or a perceived temperature, e.g., factoring in the wind chill effect to accurately predict how the air feels to an occupant. Some exemplary operating parameter adjustments include, for example, increasing the speed of compressor 34, decreasing the speed of indoor fan 42, choking the flow of refrigerant using expansion device 50, or activating an auxiliary heater (e.g., such one or more heater coils 62 within heater bank 60 or any other suitable auxiliary heater). However, it should be appreciated that other changes to the operating of unit 10 may be made according to alternative embodiments, and these examples are not intended to be limiting.

According to one exemplary embodiment of the present subject matter, adjusting an operating parameter of unit 10 may include increasing a speed of compressor 34 to increase an indoor coil temperature of indoor heat exchanger 40. For example, under standard operating conditions, compressor 34 may run at approximately 2100 revolutions per minute (RPM). By contrast, when the proximity trigger condition exists, controller 64 may operate compressor 34 at an increased speed, e.g., greater than 4000 RPM, such as 4800 RPM. Increasing the compressor speed increases the temperature of the refrigerant within indoor heat exchanger 40, thereby transferring more thermal energy to the flow of discharge air.

According to still another embodiment, unit 10 may have features for adding additional heat to the flow of discharge air, e.g., in addition to the thermal energy extracted from indoor heat exchanger 40. In this regard, for example, unit 10 may include an auxiliary heater, such as an electric resistance heating element that is positioned within indoor portion 12 for heating the flow of discharge air (see, e.g., heater bank 60). Thus, adjusting an operating parameter may include adjusting the operation of refrigeration loop 48 and/or energizing the auxiliary heater to increase the outlet temperature.

In addition, adjusting an operating parameter may include adjusting the speed of indoor fan 42 and/or outdoor fan 32. In this regard, for example, the speed of indoor fan 42 may be decreased to reduce an air velocity of the flow of discharge air. Notably, slowing down the flow of discharge air increases the heating of the air, e.g., the residence time of air within the hot indoor heat exchange coils is increased, resulting in air having a higher temperature. In addition, due to the "wind chill" effect, i.e., the perceived decrease in air temperature felt by the occupant on exposed skin due to the flow of air, lower velocity air results in discharge air that feels warmer to the occupant. In addition, adjusting the speed of outdoor fan 32 results in the retention of more thermal energy within refrigeration loop 48 which may be transferred into the room via indoor heat exchanger 40.

Other adjustments to operating parameters of unit 10 which may cause an increase in the outlet temperature include adjusting an expansion valve (e.g., expansion device 50) to choke the flow of refrigerant. In addition, according to an alternative embodiment, controller 64 may be configured for closing vent door 82 in response to determining that the proximity trigger condition exists, e.g., particularly if it is significantly colder outside. Also, controller 64 may turn off auxiliary fan 92 in response to determining that the proximity trigger condition exists to prevent urging cool air through vent aperture 80 and into the room. Other operating parameter adjustments are possible and within the scope of the present subject matter.

Now that the construction of air conditioner unit 10 and the configuration of controller 64 according to exemplary embodiments has been presented, an exemplary method 200 of operating a packaged terminal air conditioner unit will be described. Although the discussion below refers to the exemplary method 200 of operating air conditioner unit 10, one skilled in the art will appreciate that the exemplary method 200 is applicable to the operation of a variety of other air conditioning appliances. In exemplary embodiments, the various method steps as disclosed herein may be performed by controller 64 or a separate, dedicated controller.

Figure 8:
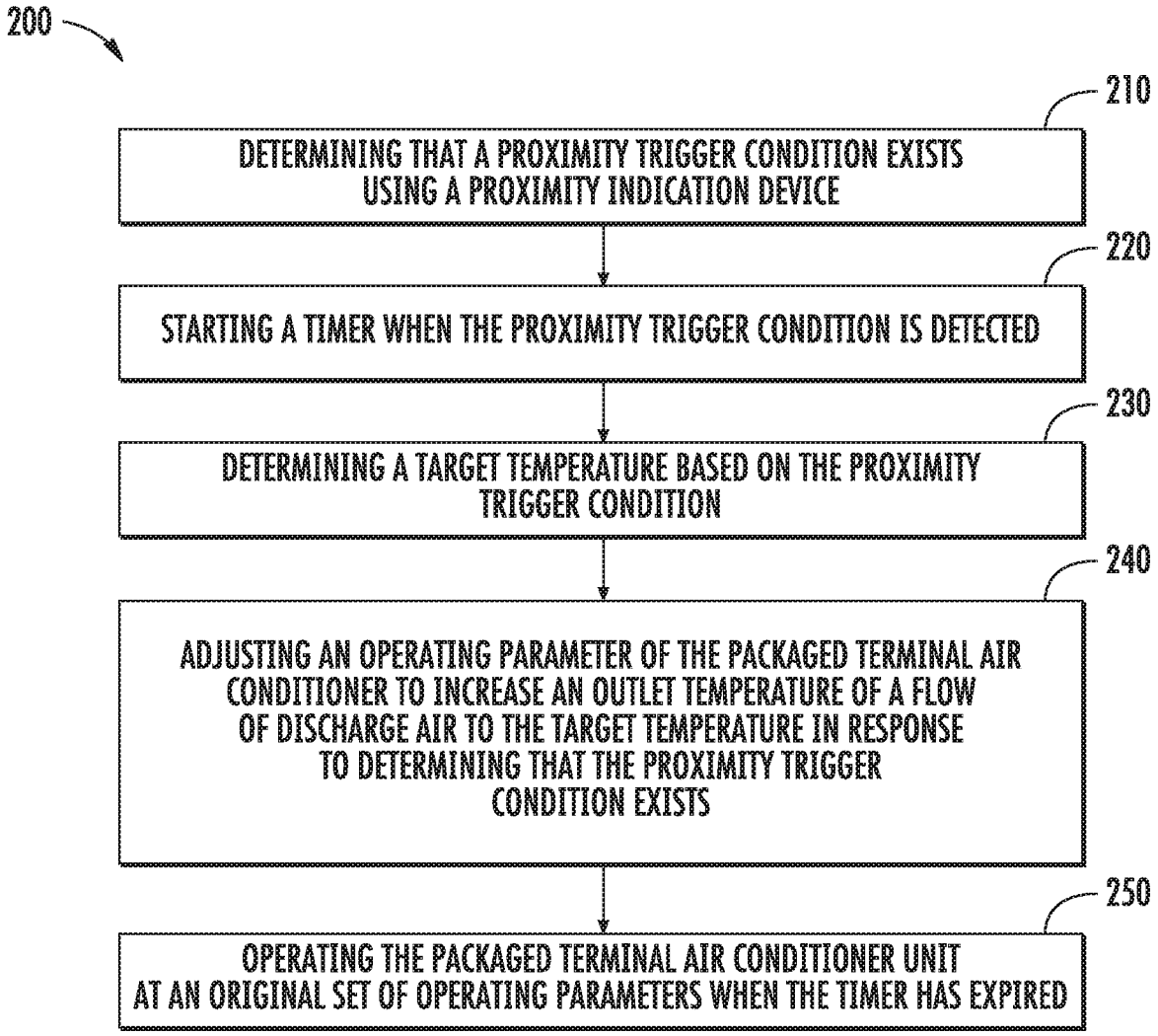
FIG. 8 illustrates a method for controlling a packaged terminal air conditioner unit in accordance with one embodiment of the present disclosure

Referring now to FIG. 8, method 200 includes, at step 210, determining that a proximity trigger condition exists using a proximity indication device. After the proximity trigger condition is detected, step 230 includes determining a target temperature based on the proximity trigger condition and regulating the outlet temperature of the flow of discharge air to that target temperature. Specifically, step 240 includes adjusting an operating parameter of the packaged terminal air conditioner to increase an outlet temperature of the flow of discharge air to the target temperature in response to determining that the proximity trigger condition exists. As explained above according to exemplary embodiments, the proximity trigger condition may be the proximity of an occupant as detected by a proximity sensor, an indication received by a user input button or a voice command system, etc. In addition, any suitable operating parameter may be adjusted to increase the outlet temperature, such as the speed of the compressor, the speed of the indoor or outdoor fan, the position of an expansion valve, etc.

According to an exemplary embodiment, the packaged terminal air conditioner unit may be configured for returning to standard operating conditions after the proximity trigger condition no longer exists or after a predetermined amount of time from the initial trigger. For example, method 200 further includes, at step 220, starting a timer when the proximity trigger condition is detected. Step 250 includes operating the packaged terminal air conditioner unit at an original set of operating parameters when the timer has expired. In this manner, the packaged terminal air conditioner unit returns to normal operation until a subsequent proximity trigger condition is detected.

FIG. 8 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 are explained using unit 10 as an example, it should be appreciated that this method may be applied to operate suitable air conditioner unit.

Figure 9:
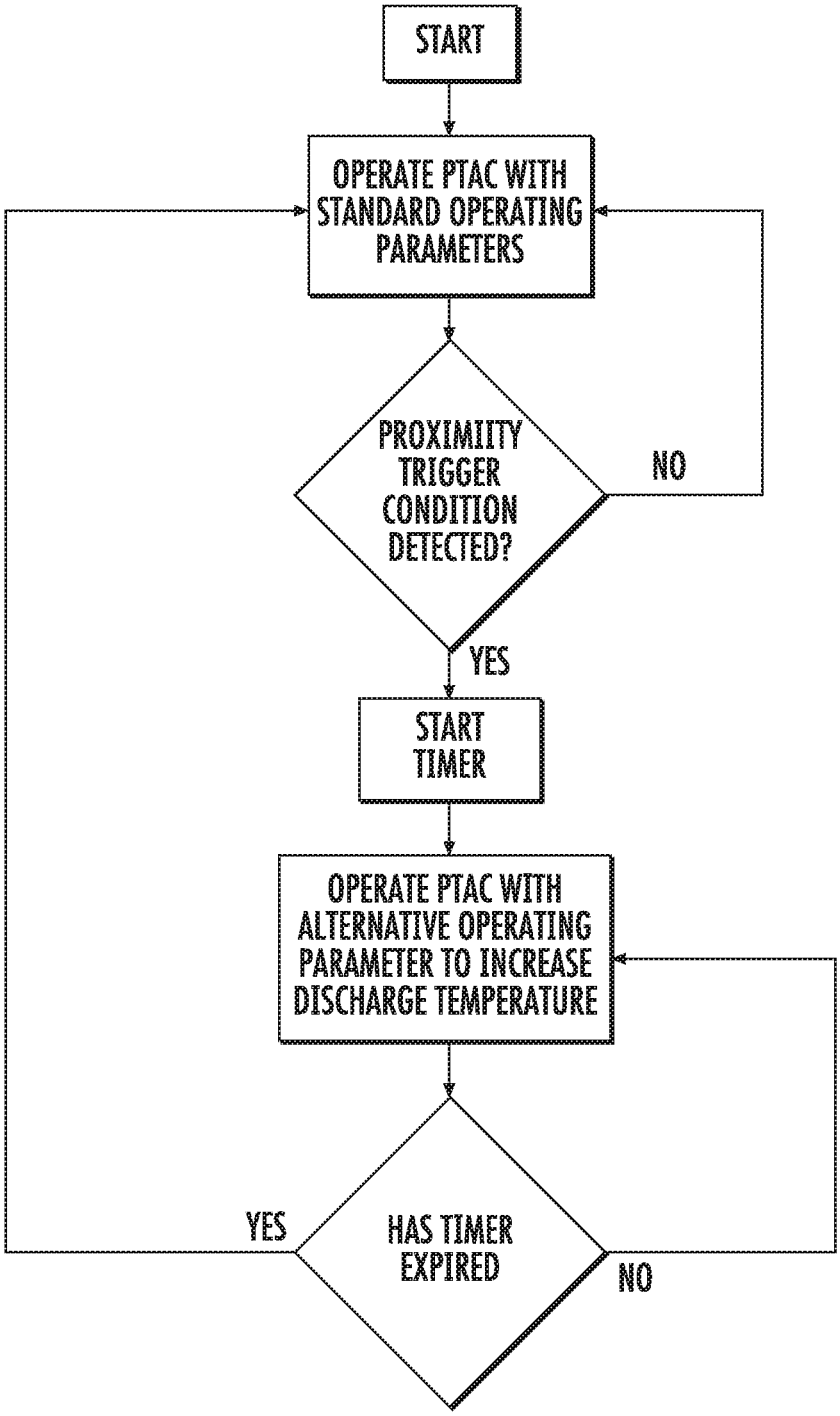
FIG. 9 illustrates an exemplary decision tree or flow diagram of an operating method of the exemplary air conditioner unit of FIG. 1 according to an exemplary embodiment of the present subject matter.

Thus, in operation, controller 64 may generally be configured for determining that a proximity trigger condition exists using proximity indication device 100 and adjusting an operating parameter of the unit 10 to increase an outlet temperature of the flow of discharge air in response to determining that the proximity trigger condition exists. One exemplary flow diagram illustrating such operation is illustrated in FIG. 9. Specifically, unit 10 operates in a standard heating mode with standard operating parameters to heat a room. When a proximity trigger condition is detected, controller 64 starts a timer and records the standard operating parameters prior to entry into an increased or boost heating mode. In this boost heating mode, one or more operating parameters of unit 10 are adjusted to increase the outlet temperature of the flow of discharge air. When the proximity trigger condition no longer exists, or when the timer expires, unit 10 adjusts its operating parameters back to the standard operating parameters recorded prior to the existence of the proximity trigger condition.

As described above, the operating parameter adjustments are used to increase the outlet temperature, e.g., to enter a "hand warming" mode. However, it should be appreciated that according to alternative embodiments, controller 64 may be configured for adjusting operating parameters of the unit 10 to decrease an outlet temperature of the flow of discharge air in response to determining that the proximity trigger condition exists. According to such an embodiment, for example, the outlet temperature of the flow of discharge air may be reduced by decreasing the speed of compressor 34, increasing the speed of indoor fan 42, adjusting expansion device 50, or activating an auxiliary cooling system.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A packaged terminal air conditioner unit comprising:

a bulkhead defining an indoor portion, an outdoor portion, and a vent aperture;

a vent door positioned proximate the vent aperture;

a refrigeration loop comprising an outdoor heat exchanger positioned within the outdoor portion and an indoor heat exchanger positioned within the indoor portion;

a compressor operably coupled to the refrigeration loop and being configured for urging a flow of refrigerant through the outdoor heat exchanger and the indoor heat exchanger;

an indoor fan configured for urging a flow of discharge air through the indoor heat exchanger and out a discharge vent;

an expansion valve fluidly coupled to the refrigeration loop within the indoor portion or the outdoor portion; and a controller operably coupled to a proximity indication device, the controller being configured for:

determining that a proximity trigger condition exists using the proximity indication device;

determining a target temperature based on the proximity trigger condition; and adjusting an operating parameter of the packaged terminal air conditioner to adjust an outlet temperature of the flow of discharge air to the target temperature in response to determining that the proximity trigger condition exists, wherein adjusting the operating parameter comprises closing the vent door in response to determining that the proximity trigger condition exists.

2. The packaged terminal air conditioner unit of claim 1, wherein the proximity indication device comprises a capacitive sensor or an electromagnetic sensor.

3. The packaged terminal air conditioner unit of claim 1, wherein the proximity indication device comprises a voice command system.

4. The packaged terminal air conditioner unit of claim 1, wherein the proximity indication device is positioned within a front panel of the packaged terminal air conditioner unit.

5. The packaged terminal air conditioner unit of claim 1, comprising:

a temperature sensor positioned within the indoor portion for measuring the outlet temperature.

6. The packaged terminal air conditioner unit of claim 1, wherein the outlet temperature is increased to a target temperature of greater than 90 degrees Fahrenheit when the proximity trigger condition exists.

7. The packaged terminal air conditioner unit of claim 1, wherein adjusting the operating parameter of the packaged terminal air conditioner comprises:

decreasing a speed of the indoor fan to reduce an air velocity of the flow of discharge air.

8. The packaged terminal air conditioner unit of claim 1, wherein adjusting the operating parameter of the packaged terminal air conditioner comprises:

increasing a speed of the compressor to increase an indoor coil temperature of the indoor heat exchanger.

9. The packaged terminal air conditioner unit of claim 8, wherein increasing the speed of the compressor comprises operating the compressor at greater than 4000 revolutions per minute.

10. The packaged terminal air conditioner unit of claim 1, further comprising:

an auxiliary heater for heating the flow of discharge air, wherein adjusting the operating parameter of the packaged terminal air conditioner comprises energizing the auxiliary heater to increase the outlet temperature.

11. The packaged terminal air conditioner unit of claim 1, further comprising:

an auxiliary fan positioned proximate the vent aperture and being configured for urging a flow of make-up air from the outdoor portion through the vent aperture to the indoor portion, wherein adjusting the operating parameter of the packaged terminal air conditioner comprises turning off the auxiliary fan in response to determining that the proximity trigger condition exists.

12. A method of operating a packaged terminal air conditioner unit, the packaged terminal conditioner unit comprising a compressor for urging a flow of refrigerant through an indoor heat exchanger and an indoor fan configured for urging a flow of discharge air through the indoor heat exchanger and out a discharge vent, and a vent door positioned over a vent aperture in a bulkhead, the method comprising:

determining that a proximity trigger condition exists using a proximity indication device;

determining a target temperature based on the proximity trigger condition; and adjusting an operating parameter of the packaged terminal air conditioner to adjust an outlet temperature of the flow of discharge air to the target temperature in response to determining that the proximity trigger condition exists, wherein adjusting the operating parameter of the packaged terminal air conditioner comprises closing the vent door in response to determining that the proximity trigger condition exists.

13. The method of claim 12, further comprising:

starting a timer when the proximity trigger condition is detected; and operating the packaged terminal air conditioner unit at an original set of operating parameters when the timer has expired.

14. The method of claim 12, comprising:

obtaining an outlet temperature using a temperature sensor; and selectively operating the indoor fan or the compressor to control the outlet temperature to the target temperature.

15. The method of claim 12, wherein the proximity indication device comprises a proximity sensor, a motion detection sensor, a user input button, or a voice command system.

16. The method of claim 12, wherein the target temperature is greater than 90 degrees Fahrenheit.

17. The method of claim 12, wherein adjusting an operating parameter of the packaged terminal air conditioner comprises:

decreasing a speed of the indoor fan to reduce an air velocity of the flow of discharge air or increasing a speed of the compressor to increase an indoor coil temperature of the indoor heat exchanger.

18. The method of claim 12, wherein adjusting an operating parameter of the packaged terminal air conditioner comprises:

adjusting an expansion valve to choke the flow of refrigerant.

* * * * *